US005700366A

United States Patent [19]

Steblianko et al.

[11] Patent Number: 5,700,366

[45] Date of Patent: Dec. 23, 1997

[54] ELECTROLYTIC PROCESS FOR CLEANING AND COATING ELECTRICALLY CONDUCTING SURFACES

[75] Inventors: Valerij Leontievich Steblianko, Magnitogorsk; Vitalij Makrovich Riabkov, Moscow, both of Russian Federation

[73] Assignee: Metal Technology, Inc., Mandeville, La.

[21] Appl. No.: 706,914

[22] Filed: Sep. 3, 1996

[30] Foreign Application Priority Data

Mar. 20, 1996 [RU] Russian Federation ..... 96104583

[51] Int. Cl.[6] ..... C25D 5/08

[52] U.S. Cl. ..... 205/87; 205/102; 205/131; 205/148; 205/219

[58] Field of Search ..... 205/87, 95, 131, 205/148, 151, 219, 705, 714, 715, 716

[56] References Cited

U.S. PATENT DOCUMENTS

| | | | |
|---|---|---|---|
| 3,620,934 | 11/1971 | Endle | 205/87 |
| 3,834,999 | 9/1974 | Hradcovsky et al. | 205/318 |
| 4,033,274 | 7/1977 | Beese | 72/347 |
| 4,046,644 | 9/1977 | Liska | 205/170 |
| 4,304,641 | 12/1981 | Grandia et al. | 205/96 |
| 4,374,719 | 2/1983 | Bakewell et al. | 204/202 |
| 4,405,432 | 9/1983 | Kosowsky | 204/206 |
| 4,490,218 | 12/1984 | Kadija et al. | 205/77 |
| 4,508,396 | 4/1985 | Doi et al. | 384/463 |
| 4,529,486 | 7/1985 | Polan | 205/77 |
| 4,810,343 | 3/1989 | Bonnardel | 204/224 R |
| 5,232,563 | 8/1993 | Warfield | 205/766 |

FOREIGN PATENT DOCUMENTS

| | | |
|---|---|---|
| 1165271 | 4/1984 | Canada . |
| 0037190 | 10/1981 | European Pat. Off. . |
| 0406417 | 12/1988 | European Pat. Off. . |
| 0657564 | 6/1995 | European Pat. Off. . |
| 892919 | 1/1944 | France . |
| 2561672 | 9/1985 | France . |
| 3715454 | 11/1988 | Germany . |
| 4031234 | 4/1992 | Germany . |
| 08003794 | 1/1996 | Japan . |
| 1244216 | 7/1986 | U.S.S.R. . |
| 1599446 | 10/1990 | U.S.S.R. . |
| 1306337 | 2/1973 | United Kingdom . |
| 1399710 | 2/1975 | United Kingdom . |
| 1436744 | 5/1976 | United Kingdom . |

OTHER PUBLICATIONS

Metal Finishing Guidebook and Directory for 1975, Metals and Plastics Publications, Inc., Hackensack, N.J., 1975, p., 67. No month available.

A.V. Timoshenko et al., "The Effect of Silicates in Sodium–Hydroxide Solution . . . by Microarc Oxidation" in *Protection of Metals*, vol. 30, No. 2, 1944, pp. 175–180. No month available.

*Primary Examiner*—Kathryn L. Gorgos
*Assistant Examiner*—William T. Leader
*Attorney, Agent, or Firm*—Watson Cole Stevens Davis, P.L.L.C.

[57] ABSTRACT

An electrolytic process for simultaneously cleaning and metal-coating the surface of a workpiece of an electrically conducting material, which process comprises: i) providing an electrolytic cell with a cathode comprising the surface of the workpiece and an anode comprising the metal for metal-coating of the surface of the workpiece; ii) introducing an electrolyte into the zone created between the anode and the cathode by causing it to flow under pressure through at least one opening in the anode and thereby impinge on the cathode; and iii) applying a voltage between the anode and the cathode and operating in a regime in which the electrical current decreases or remains substantially constant with increase in the voltage applied between the anode and the cathode, and in a regime in which discrete gas bubbles are present on the surface of the workpiece during treatment.

23 Claims, 4 Drawing Sheets

ELECTRODE SEPARATION = 12mm
TEMPERATURE = 30°c
Q = ELECTROLYTE FLOW RATE

ELECTRODE SEPARATION = 12mm
TEMPERATURE = 40°c
Q = ELECTROLYTE FLOW RATE

ELECTRODE SEPARATION = 12mm
TEMPERATURE = 60°c
Q = ELECTROLYTE FLOW RATE

ELECTROLYTIC PROCESS FOR CLEANING AND COATING ELECTRICALLY CONDUCTING SURFACES

BACKGROUND OF INVENTION

The present invention relates to a process for simultaneously cleaning and metallizing an electrically conducting surface, such as a metal surface.

Metals, notably steel in its many forms, usually need to be cleaned and/or protected from corrosion before being put to their final use. As produced, steel normally has a film of mill-scale (black oxide) on its surface which is not uniformly adherent and renders the underlying material liable to galvanic corrosion. The mill-scale must therefore be removed before the steel can be painted, coated or metallized (e.g. with zinc). The metal may also have other forms of contamination (known in the industry as "soil") on its surfaces including rust, oil or grease, pigmented drawing compounds, chips and cutting fluid, and polishing and buffing compounds. All of these must normally be removed. Even stainless steel may have an excess of mixed oxide on its surface which needs removal before subsequent use.

Traditional methods of cleaning metal surfaces include acid pickling (which is increasingly unacceptable because of the cost and environmental problems caused by the disposal of the spent acid); abrasive blasting; wet or dry tumbling; brushing; salt-bath descaling; alkaline descaling and acid cleaning. A multi-stage cleaning operation might, for example, involve (i) burning-off or solvent-removal of organic materials, (ii) sand- or shot-blasting to remove mill-scale and rust, and (iii) electrolytic cleaning as a final surface preparation. If the cleaned surface is to be given anti-corrosion protection by metallizing, painting or plastic coating, this must normally be done quickly to prevent renewed surface oxidation. Multi-stage treatment is effective but costly, both in terms of energy consumption and process time. Many of the conventional treatments are also environmentally undesirable.

Electrolytic methods of cleaning metal surfaces are frequently incorporated into processing lines such as those for galvanizing and plating steel strip and sheet. Common coatings include zinc, zinc alloy, tin, copper, nickel and chromium. Stand-alone electrolytic cleaning lines are also used to feed multiple downstream operations. Electrolytic cleaning (or "electro-cleaning") normally involves the use of an alkaline cleaning solution which forms the electrolyte while the workpiece may be either the anode or the cathode of the electrolytic cell, or else the polarity may be alternated. Such processes generally operate at low voltage (typically 3 to 12 volts) and current densities from 1 to 15 Amps/dm$^2$. Energy consumptions thus range from about 0.01 to 0.5 kWh/m$^2$. Soil removal is effected by the generation of gas bubbles which lift the contaminant from the surface. When the surface of the workpiece is the cathode, the surface may not only be cleaned but also "activated", thereby giving any subsequent coating an improved adhesion. Electrolytic cleaning is not normally practicable for removing heavy scale, and this is done in a separate operation such as acid pickling and/or abrasive-blasting.

Conventional electrolytic cleaning and plating processes operate in a low-voltage regime in which the electrical current increases monotonically with the applied voltage (see FIG. 1 hereinafter at A). Under some conditions, as the voltage is raised, a point is reached at which instability occurs and the current begins to decrease with increasing voltage (see FIG. 1 hereinafter at B). The unstable regime marks the onset of electrical discharges at the surface of one or other of the electrodes. These discharges ("micro-arcs" or "micro-plasmas") occur across any suitable non-conducting layer present on the surface, such as a layer of gas or vapour. This is because the potential gradient in such regions is very high.

PRIOR ART

GB-A-1399710 teaches that a metal surface can be cleaned electrolytically without over-heating and without excessive energy consumption if the process is operated in a regime just beyond the unstable region, the "unstable region" being defined as one in which the current decreases with increasing voltage. By moving to slightly higher voltages, where the current again increases with increasing voltage and a continuous film of gas/vapour is established over the treated surface, effective cleaning is obtained. However, the energy consumption of this process is high (10 to 30 kWh/m$^2$) as compared to the energy consumption for acid pickling (0.4 to 1.8 kWh/m$^2$).

SU-A-1599446 describes a high-voltage electrolytic spark-erosion cleaning process for welding rods which uses extremely high current densities, of the order of 1000 A/dm$^2$, in a phosphoric acid solution.

SU-A-1244216 describes a micro-arc cleaning treatment for machine parts which operates at 100 to 350 V using an anodic treatment. No particular method of electrolyte handling is taught.

Other electrolytic cleaning methods have been described in GB-A-1306337 where a spark-erosion stage is used in combination with a separate chemical or electro-chemical cleaning step to remove oxide scale; in U.S. Pat. No. 5,232,563 where contaminants are removed at low voltages from 1.5 to 2 V from semi-conductor wafers by the production of gas bubbles on the wafer surface which lift off contaminants; in EP-A-0657564, in which it is taught that normal low-voltage electrolytic cleaning is ineffective in removing grease, but that electrolytically oxidisable metals such as aluminum may be successfully degreased under high voltage (micro-arc) conditions by acid anodisation.

The use of jets of electrolyte situated near the electrodes in electrolytic cleaning baths to create high speed turbulent flow in the cleaning zone is taught for example in JP-A-08003797 and DE-A-4031234.

The electrolytic cleaning of radioactively contaminated objects using a single jet of electrolyte without overall immersion of the object, is taught in EP-A-0037190. The cleaned object is anodic and the voltage used is between 30 to 50 V. Short times of treatment of the order of 1 sec are recommended to avoid erosion of the surface and complete removal of oxide is held to be undesirable. Non-immersion is also taught in CA-A-1165271 where the electrolyte is pumped or poured through a box-shaped anode with an array of holes in its base. The purpose of this arrangement is to allow a metal strip to be electro-plated on one side only and specifically to avoid the use of a consumable anode.

DE-A-3715454 describes the cleaning of wires by means of a bipolar electrolytic treatment by passing the wire through a first chamber in which the wire is cathodic and a second chamber in which the wire is anodic. In the second chamber a plasma layer is formed at the anodic surface of the wire by ionisation of a gas layer which contains oxygen. The wire is immersed in the electrolyte throughout its treatment.

EP-A-0406417 describes a continuous process for drawing copper wire from copper rod in which the rod is plasma cleaned before the drawing operation. The "plasmatron" housing is the anode and the wire is also surrounded by an inner co-axial anode in the form of a perforated U-shaped sleeve. In order to initiate plasma production the voltage is maintained at a low but unspecified value, the electrolyte level above the immersed wire is lowered, and the flow-rate decreased in order to stimulate the onset of a discharge at the wire surface.

With regard to coating, micro-arc processes have been described for the deposition of oxide and silicate coatings on metals. In these processes coating takes place at the anode, and this is substantially true even when polarity is reversed periodically (References U.S. Pat. No. 3,834,999; A. V. Timoshenko et al., Protection of Metals, Vol. 30, No. 2, 1944, pp. 175–180).

Russian Authors Certificate No. USSR 1544844 describes a method for depositing a metallic coating on a metal surface by using a separate cathode and bringing it into contact periodically with the surface or body to be treated. The deposited metal is provided by erosion of the anode metal, but, the method is mechanically awkward, slow and inefficient.

Otherwise, coating is invariably carried out on a pre-cleaned surface, by known methods such as heat-bonding for plastic coatings and electro-plating or electro-less plating for metallic coatings.

Whilst low voltage electrolytic cleaning is widely used to prepare metal surfaces for electro-plating or other coating treatments, it cannot handle thick oxide deposits such as mill-scale without an unacceptably high expenditure of energy. Such electrolytic cleaning processes must normally be used, therefore, in conjunction with other cleaning procedures in a multi-stage operation. Although electrolytic cleaning may be used on-line to prepare metal surfaces for electrolytic or other coating processes, there is no process described in the prior art by which cleaning and coating ("metallizing") can be accomplished simultaneously in a single step.

We have now developed a process by which a workpiece may be cleaned and metallized in a single step. The metallic coating obtained by this process merges with the underlying body metal to provide a progressive transition in composition, rather than the sharp interface between body and coating obtained with electro-plating, which in turn affords optimum adhesion between the substrate and metal coating.

SUMMARY OF THE INVENTION

Accordingly, in one aspect the present invention provides an electrolytic process for simultaneously cleaning and metal-coating the surface of a workpiece of an electrically conducting material, which process comprises:

i) providing an electrolytic cell with a cathode comprising the surface of the workpiece and an anode comprising the metal for metal-coating of the surface of the workpiece;

ii) introducing an electrolyte into the zone created between the anode and the cathode by causing it to flow under pressure through one or more holes, channels or apertures in the anode and thereby impinge on the cathode; and iii) applying a voltage between the anode and the cathode and operating in a regime in which the electrical current decreases or remains substantially constant with increase in the voltage applied between the anode and the cathode, and in a regime in which discrete bubbles of gas and/or vapour are present on the surface of the workpiece during treatment.

DETAILED DESCRIPTION OF THE INVENTION

Figure 1:
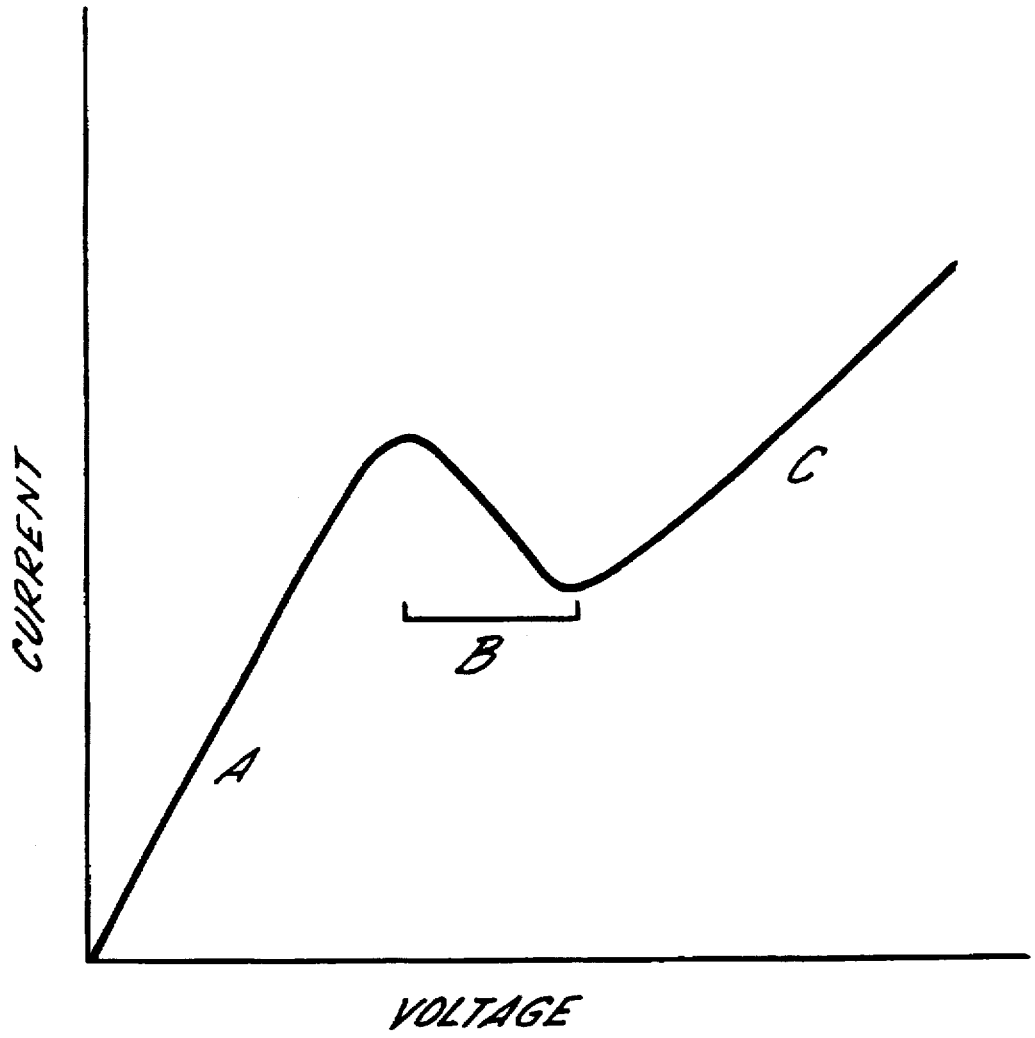
FIG. 1 illustrates schematically the regime of operation where the electrical current decreases, or does not increase with increase in the applied voltage.

In carrying out the method of the present invention the workpiece has a surface which forms the cathode in an electrolytic cell. The anode is composed of or incorporates the metallizing material, namely the metal to be coated onto the cathode. The process is operated in a regime in which the electrical current decreases, or at least does not increase significantly, with an increase in voltage applied between the anode and the cathode. The process of the present invention may be carried out as a continuous or semi-continuous process by arranging for relative movement to take place of the workpiece in relation to the anode or anodes. Alternatively, stationary articles may be treated according to the process of the invention. The electrolyte is introduced into the working zone between the anode and the cathode by causing it to flow under pressure through at least one hole, channel or aperture in the anode, whereby it impinges on the cathode (the surface under treatment). The electrolyte may optionally contain a soluble ionisable compound of the coating metal (which is also the anode metal).

Each of these features are described in more detail below.

Cathodic arrangement of the surface to be treated

The workpiece can be of any shape or form including sheet, plate, tube, pipe, wire or rod. The surface of the workpiece which is treated in accordance with the process of the invention is that of the cathode. For safety reasons, the cathodic workpiece is normally earthed. This does not rule out the use of alternating polarity, but the transport of metallic ions from the anode to the workpiece, can occur only while the treated surface is cathodic. The applied positive voltage at the anode may be pulsed.

The cathodic processes involved at the treated surface are complex and may include among other effects; chemical reduction of oxide; cavitation; destruction of crystalline order by shock waves; and ion implantation.

Composition of the anode

The anode is formed from one or more conducting materials which suffer erosion during the process of the invention in such a way that the eroded material is deposited as a coating on the treated surface. If the anode is made from the same material as that of the cathode, then cleaning is the effective result since any coating is of the same nature as the surface on which it is deposited.

It is common to use consumable anodes in normal electroplating processes (such as galvanizing steel) in order to maintain the metal ion concentration in the electrolyte (See e.g. CA 1165271). However, in normal low-voltage electroplating the coating metal is deposited from the electrolyte, not conveyed directly from a sacrificial anode as in the present invention. Unlike normal electro-plating, it is not necessary in the process of the present invention for the electrolyte to contain a salt of the coating metal (although low concentrations of such salts may improve the surface finish obtained, as discussed later).

The anode may be a pure metal, or an alloy of two or more metals. If the anode is an alloy, the coating obtained is also an alloy of the same constituent metals but the coating will not generally have the same quantitative composition as the anode alloy. This is because, among other things, the transport rates of the different metallic ions differ.

The anode may be a micro- or macro-composite of two or more metals which will also result in an alloy coating, provided that the composite structure of the anode is on an appropriate scale. Alternatively a composite anode enables multi-layer coatings to be deposited by arranging for the anode (or series of anodes) to consist of two or more metals arranged in sequence along the direction of relative travel of the anode and workpiece. An almost limitless range of alloy structures can be achieved in the coating by combining different metals in different proportions in a composite anode without the limitations normally imposed by equilibrium phase diagrams. Other possibilities include parallel stripes of different coating metals running along the said direction of travel. It is also possible by disposing anodes on either side of the workpiece to metallize the opposite sides of a metal strip or article with different coatings and/or different thicknesses of coating. This ability to control the composition and thickness of the metallic coating could be of value in a number of industrial applications, such as electronics.

Physical form of the anode

The anode will generally be of such a shape that its surface lies at a substantially constant distance (the "working distance") from the cathode (the surface to be treated). This distance may typically be about 12 mm. Thus if the treated surface is flat, the anode surface will generally also be flat, but if the former is curved the anode may also advantageously be curved to maintain a substantially constant distance. Nonconducting guides or separators may also be used to maintain the working distance in cases where the working distance cannot be readily controlled by other means.

The anode may be of any convenient size, although large effective anode areas may be better obtained by using a plurality of smaller anodes since this facilitates the flow of electrolyte and debris away from the working area and improves heat dissipation. When more than one anode is used, different anodes may be made of different metals or alloys.

A key aspect of the invention is that the electrolyte is introduced into the working area by flow under pressure through the anode which is provided with at least one and preferably a plurality of holes, channels or apertures for this purpose. Such holes may conveniently be of the order of 1–2 mm in diameter and 1–2 mm apart. In a composite anode, the size and frequency of the holes may be varied from one component of the composite to the next to provide yet another means of controlling the coating composition.

The effect of this electrolyte handling method is that the surface of the workpiece which is to be treated is bombarded with streams, sprays or jets of electrolyte. Preferably the surface of the workpiece which is to be treated is not otherwise immersed in the electrolyte. It will be understood, however, that the process of the invention can be carried out with the immersion of the workpiece in the electrolyte, if desired. The electrolyte, together with any debris generated by the cleaning action, runs off the workpiece and can be collected, filtered, cooled and recirculated as necessary. Flow-through arrangements are commonly used in electroplating (see U.S. Pat. No. 4,405,432; U.S. Pat. No. 4,529,486 and CA 1165271), but have not previously been used in the micro-plasma regime, nor with the specific purpose of conveying metal ions from an eroding anode to the workpiece.

Any physical form of the anode may be used which permits the electrolyte to be handled as described above. Thus, for example the whole anode may be made of the coating ("sacrificial") metal or metals; the sacrificial metal (s) may comprise a perforated face-plate attached by a quick-release system to a permanent (non-sacrificial) anode block containing holes for the passage of electrolyte; the sacrificial metal(s) may comprise a wire mesh attached to a non-sacrificial anode structure; the sacrificial metal(s) may comprise wires or rods which are fed continuously through holes in an inert anode block, the electrolyte being allowed to flow under pressure through the same or different holes; or the sacrificial metal(s) may comprise a perforated strip of metal which traverses slowly and continuously across a moving workpiece, and transversely to its direction of travel, using suitable supports add guides to maintain the anode at a constant working distance from the workpiece, so that fresh sacrificial material is always available at the anode and a continuous production process can be run without interruption.

Optionally, an electrically insulated screen containing finer holes than the anode itself may be interposed between the anode and the workpiece. This screen serves to refine the jet or jets emerging from the anode into finer jets which then impinge on the workpiece.

Finally, the process allows separate coatings to be placed on two sides of a workpiece by arranging for separate anodes to be placed on each side thereof. The coatings may be made of different materials depending on the composition of the respective anodes, and/or the two coatings may also be of different thicknesses which may be achieved by, for example, placing the anodes at different inter-electrode distances from the workpiece, or by using anodes of different lengths (as measured in the direction of travel of the workpiece) or by otherwise changing the time of treatment on one side relative to the other.

Regime of operation

The process is operated in a regime in which the electrical current decreases, or at least does not increase significantly, with an increase in voltage applied between the anode and the cathode. This is region B in FIG. 1 and was previously referred to as the "unstable region" in UK-A-1399710. This regime is one in which discrete bubbles of gas and vapour are present on the surface of the workpiece which is being treated, rather than a continuous gas film or layer. This distinguishes the regime employed from that employed in UK-A-1399710 which clearly teaches that the gas film must be continuous.

Successful establishment of the desired "bubble" regime depends upon finding an appropriate combination of a number of variables, including the voltage (or the power consumption), the inter-electrode separation, the electrolyte flow rate, the electrolyte temperature and external influences as known in the art such as ultrasonic irradiation.

Ranges of variables

The ranges of the variables within which useful results can be obtained are as follows:

Voltage

The range of voltage employed is that denoted by B in FIG. 1 and within which the current decreases or remains substantially constant with increasing voltage. The actual numerical voltages depend upon several variables, but will generally be in the range of from 10 V to 250 V, according to conditions. The onset of the unstable region, and thus the lower end of the usable voltage range (denoted $V_{cr}$), can be represented by an equation of the form;

$$V_{cr}=n\,(l/d)\,(\lambda/\alpha\sigma_H)^{0.5}$$

where n is a numerical constant l is the inter-electrode distance d is the diameter of the gas/vapour bubbles on the surface $\lambda$ is the electrolyte heat transfer coefficient $\alpha$ is the temperature coefficient of heat emission $\sigma_H$ is the initial specific electroconductivity of the electrolyte This equation demonstrates how the critical voltage for the onset of instability depends upon certain of the variables of the system. For a given electrolyte it can be evaluated, but only if n and d are known, so that it does not allow a prediction of critical voltage ab initio. It does, however, show how the critical voltage depends on the inter-electrode distance and the properties of the electrolyte solution.

Inter-electrode separation

The anode-to-cathode separation, or the working distance, is generally within the range of from 3 to 30 mm, preferably within the range of from 5 to 20 mm.

Electrolyte flow rate

The flow rates may vary quite widely, between 0.02 and 0.2 liters per minute per square centimeter of anode ($1/min.cm^2$). The flow channels through which the electrolyte enters the working region between the anode and the workpiece are preferably arranged to provide a uniform flow field within this region. Additional flow of electrolyte may be promoted by jets or sprays placed in the vicinity of the anode and workpiece, as is known in the art, so that some (but not all) of the electrolyte does not pass through the anode itself.

Electrolyte temperature

The electrolyte temperature may also have a significant effect upon the attainment of the desired "bubble" regime. Temperatures in the range of from 10° C. to 85° C. can be usefully employed. It will be understood that appropriate means may be provided in order to heat or cool the electrolyte and thus maintain it at the desired operating temperature.

Electrolyte composition

The electrolyte composition comprises an electrically conducting aqueous solution which does not react chemically with any of the materials it contacts, such as a solution of sodium carbonate, potassium carbonate, sodium chloride, sodium nitrate or other such salt. The solute may conveniently be present at a concentration of 8% to 12% though this is by way of example only and does not limit the choice of concentration.

The electrolyte may also contain a soluble ionisable compound of the anode (coating) metal. The coating performance improves (in the sense that a smoother coating is obtained) as this second component is added to the electrolyte in the range from 1% concentration to saturation and preferably from 3% to 20%. Higher concentrations (up to saturation) may be used but no further improvement in coating performance results. Clearly, if the anode consists of more than one metal, salts of each component metal may be included in the electrolyte.

Suitable combination of variables

Figure 2A:
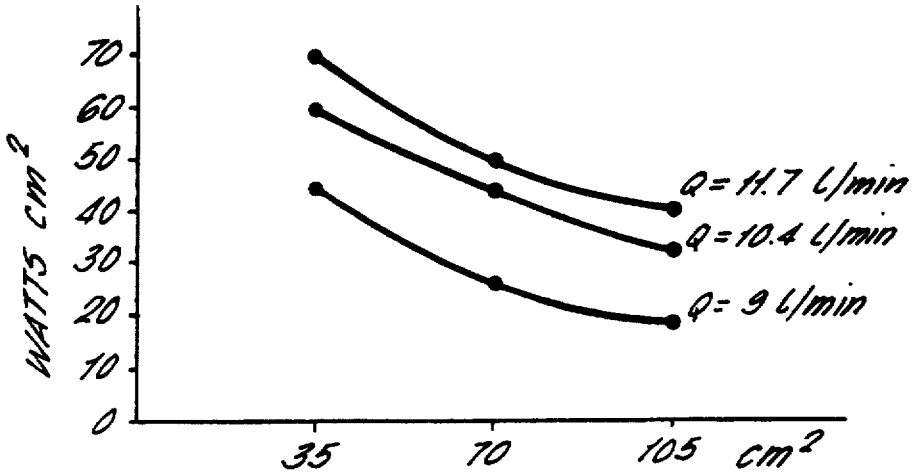
FIGS. 2*a*, 2*b* and 2*c* illustrate operating parameters where the desired operating conditions are achieved.
Figure 2B:
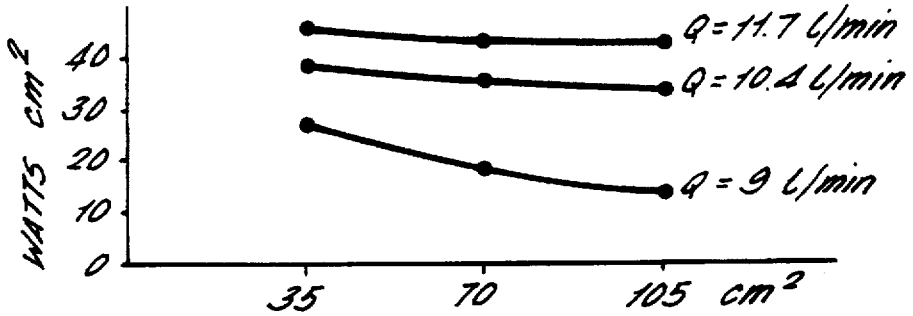
Figure 2C:
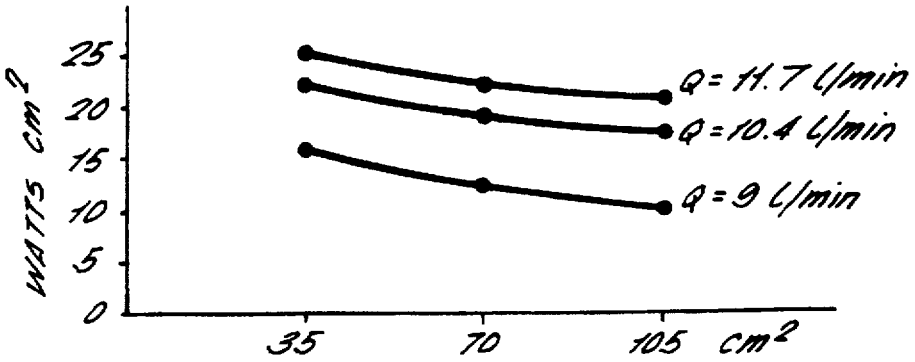

It should be clearly understood that the required "bubble" regime cannot be obtained with any arbitrary combination of the variables discussed above. The desired regime is obtained only when a suitable combination of these variables is selected. One such suitable set of values can be represented by the curves reproduced in FIG. 2*a*, 2*b* and 2*c* which show, by way of example only, some combinations of the variables for which the desired regime is established, using a 10% sodium carbonate solution. Once the anode area, working distance, electrolyte flow rate and electrolyte temperature have been chosen and set, the voltage is increased while measuring the current until the wattage (voltage×current) reaches the levels given in FIG. 2*a*, 2*b* and 2*c*. It will be understood by those skilled in the art that other combinations of variables not specified in FIG. 2*a*, 2*b* and 2*c* may be used to provide the "bubble" regime with satisfactory results being obtained.

The process of the present invention may be used to treat the surface of a workpiece of any desired shape or configuration. In particular, the process may be used to treat a metal in sheet form, for example the zinc coating of ferrous metal sheet or the tin plating of metal sheet, or to treat the inside or outside of a steel pipe, or to treat the surface of a free-standing object.

The process of the invention enables cleaning and metal coating to be achieved as a single operation at no significantly greater energy consumption than for cleaning alone. Even when the only purpose is to clean a surface, for example when a plastic coating is to be applied to the surface, it is possible, without additional time or energy cost, to apply a small amount of a metal coating to the surface in order to stabilise the surface against further oxidation and (in some cases) to promote keying.

Furthermore, in most known electrolytic cleaning and plating methods it is necessary to immerse the surface of the workpiece which is to be treated in the electrolyte. We have also found that there is a large and surprising decrease in energy consumption (compared with the immersed case) when the process of the invention is carried out without the anode and the treated surface being immersed in the electrolyte.

The present invention allows a multi-stage process to be replaced by a single stage process in which simultaneous cleaning and metal-coating is achieved. The method is environmentally friendly and energy efficient as compared to the conventional processes. When the anode is made of the same material as the workpiece, the overall process can be considered to be one of cleaning without coating, although at least some metal from the anode will actually transfer to the surface being cleaned. Cleaned surfaces have a high degree of roughness which facilitates the adhesion of non-metallic coatings thereto. The metal coatings obtained have excellent adhesion to the metal surface of the workpiece because the coating material penetrates into and merges with the metal of the workpiece.

The process of the invention offers economic advantages over the existing cleaning/coating processes, whilst also promoting the adhesion of the coatings to the surface of the workpiece. A further feature is that while the process may be carried out with the workpiece immersed in the electrolyte, immersion is not preferred and operation without immersion, by jetting or spraying the electrolyte through channels holes or apertures in the anode, so that the electrolyte impinges on the surface to be treated, leads to a large reduction in energy consumption relative to operation with immersion, providing further commercial advantage. Operation without immersion also frees the process from the constraints imposed by the need to contain the electrolyte and permits the in-situ treatment of free-standing objects of various shapes.

The process of the present invention is further described with reference to FIGS. 3 to 7 of the accompanying drawings.

Figure 3:
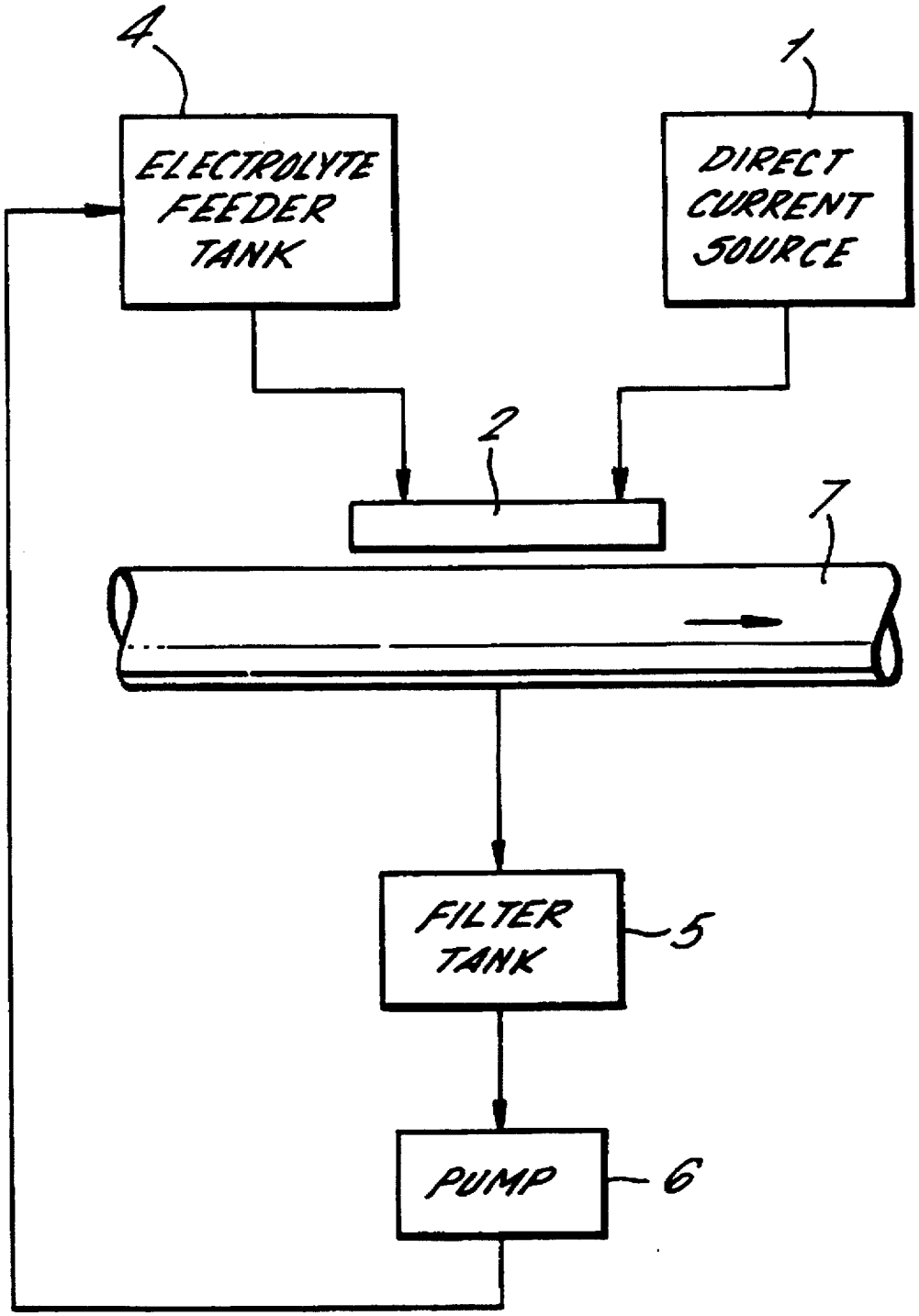
FIG. 3 illustrates schematically the process of the present invention.
Figure 4:
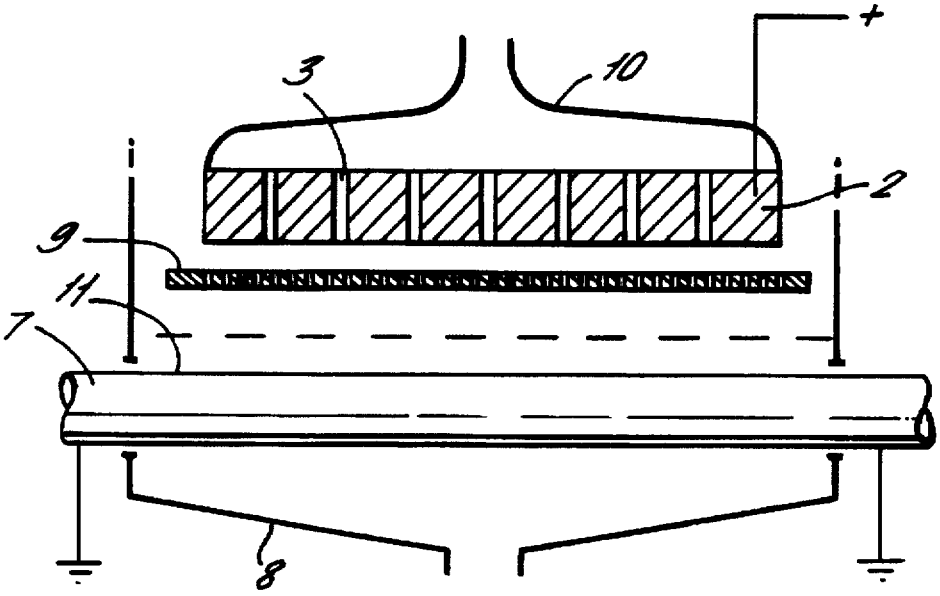
FIG. 4 illustrates schematically an apparatus for carrying out the process of the invention on one side of an object.

Referring to these drawings, an apparatus for implementing the process of the present invention is schematically illustrated in FIGS. 3 and 4. A direct current source 1 has its positive pole connected to anode 2, which has channels 3 provided therein through which an electrolyte from feeder tank 4 is pumped. The workpiece to be coated 7 is connected as the cathode in the apparatus and optionally earthed. The electrolyte from feeder tank 4 may be pumped via a distributor 10 to the anode 2 in order to ensure an even flow of electrolyte through the channels 3 in the anode. An electrically insulated screen 9, which has finer apertures than the channels 3 in the anode, is placed between the anode and the workpiece 7 in order to cause the electrolyte sprayed from the anode channels 3 to break up into finer sprays.

As shown schematically in FIG. 3, the apparatus is provided with a filter tank 5 for separating debris from the electrolyte, and a pump 6 to circulate the filtered electrolyte back to the electrolyte feed tank. Also as shown in FIG. 3, it is envisaged that the workpiece 7 will pass through a working chamber 8, which is constructed in a manner such that longitudinal movement of the workpiece through the chamber can take place. Chamber 8 is also supplied with means to direct the flow of electrolyte to the filter block 5.

Figure 5:
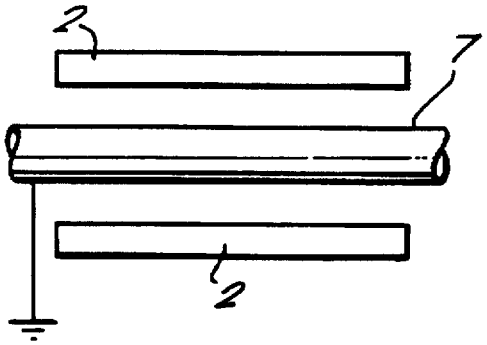
FIG. 5 illustrates schematically an apparatus for carrying out the process of the invention for the application of coating layers of equal thickness on both sides of an object.

FIG. 5 illustrates schematically a part of an apparatus for coating both sides of a workpiece 7 in which two anodes 2 are placed on either side of the workpiece 7 and are both equidistantly spaced from the workpiece.

Figure 6:
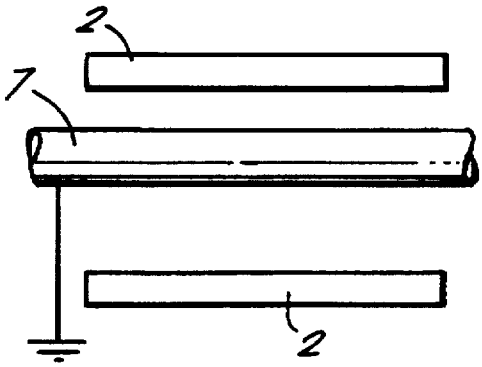
FIG. 6 illustrates schematically an apparatus for carrying out the process of the invention for the application of coating layers of different thicknesses on the two sides of an object.

FIG. 6 illustrated schematically a part of an apparatus for coating the two sides of a workpiece 7 with coatings of different thickness. As shown, the two anodes 2 are spaced at different distances from the surfaces of the workpiece 7. Alternatively, the two anodes may be of different lengths (not shown) causing the time of treatment of a moving workpiece to differ on the two sides thus giving rise to different coating thicknesses on the two surfaces.

Figure 7:
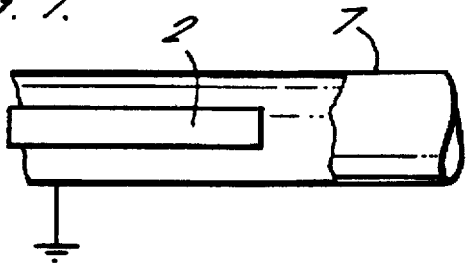
FIG. 7 illustrates schematically an installation for coating the inner surface of a pipe.

FIG. 7 illustrates schematically a part of an apparatus for coating the inside surface of a pipe which forms the workpiece 7. In this arrangement the anode 2 is positioned within the pipe with appropriate arrangements being provided for the supply of the electrolyte to the anode.

In carrying out the process of the present invention the conditions are so chosen that discrete bubbles of gas and/or vapour are formed on the surface 11 of the workpiece 7. Electrical discharges through the bubbles of gas or vapour formed on the surface cause impurities to be removed from the surface during the processing and those products are removed by the electrolyte flow and filtered by filter block 5. The process of cleaning the surface of the workpiece 7 is also accompanied by the coating of the cleaned surface with the material of the anode 2.

The present invention also includes within its scope a metal workpiece which has been cleaned and coated with a metal other than that of the workpiece in accordance with the process of the invention, there being a gradual transition in composition from the metal of the workpiece to that of the coating metal.

The present invention still further includes within its scope a metal workpiece which has been cleaned and coated with a metal the same as that of the workpiece in accordance with the process of the invention, wherein the surface of the metal coating is of a porous nature such as to facilitate the mechanical keying thereto of any subsequently applied coating.

The present invention will be further described with reference to the following Examples.

EXAMPLE 1

A hot-rolled steel strip having a 5 micrometer layer of mill-scale (black oxide) on its surface was treated according to the method of the invention using a steel anode. The workpiece was held stationary and was not immersed in the electrolyte. The parameters employed were as follows;

| | |
|---|---|
| Electrolyte: | 10% by weight aqueous solution of sodium carbonate |
| Voltage: | 120 V |
| Electrode separation: | 12 mm |
| Area of anode: | 105 $cm^2$ |
| Area treated: | 80 $cm^2$ |
| Electrolyte flow rate: | 9 l/min total |
| Electrolyte temp.: | 60 deg C. |

After a cleaning time of 15 seconds and a specific energy consumption of 0.42 $kWb/m^2$, a clean grey metal surface was obtained which showed no sign of oxide either visually or when examined using a scanning electron microscope using dispersive X-ray analysis. The surface topography was deeply pitted on a microscopical scale, providing the potential for keying to any subsequent coating.

EXAMPLE 2

The procedure of Example 1 was repeated but using a steel strip with a 15 micrometer thick layer of mill-scale. The time for cleaning was 30 seconds and the specific energy consumption was 0.84 $kWh/m^2$.

EXAMPLE 3

The procedures of Examples 1 and 2 were repeated with the workpiece immersed in the electrolyte to a depth of 5 mm. The specific energy consumptions required for complete cleaning were as follows;

5 micrometers of mill-scale 3.36 $kWh/m^2$ 15 micrometers of mill-scale 6.83 $kWh/m^2$ It is seen that immersing the workpiece has the effect of raising the energy consumption by a factor of about 8, thereby greatly increasing the energy cost.

EXAMPLE 4

The procedure of Example 1 was repeated using a steel strip without mill-scale, but having a layer of rust and general soil on its surface. Complete cleaning was obtained in 2 seconds or less at a specific energy consumption of 0.06 $kWh/m^2$.

EXAMPLE 5

A rolled steel strip which had previously been cleaned as in Example 1 was coated with lead by using a lead anode in place of the steel anode. Otherwise all the process parameters were as in Example 1 and the workpiece was not immersed in the electrolyte. After a treatment time of 18 seconds, a lead coating 6 to 7 micrometers thick had been formed on the workpiece at a specific energy consumption of 0.48 kWh/m$^2$. X-ray analysis revealed the presence of lead within the steel body-metal to a depth of 2–3 micrometers below the lead coating itself and forming an ordered alloy with the steel. Since steel and lead are normally non-miscible, such alloy structures are not normally obtainable. This result also indicates that there is a progressive variation in metallurgical composition from that of the body-metal to that of the coating, giving superior coating adhesion to that obtainable by conventional methods such as electro- or electroless-plating, dipping etc.

EXAMPLE 6

The procedure of Example 5 was repeated but using a steel strip that had not been pre-cleaned but which still carried a 5 micrometer layer of mill-scale on its surface. All of the process parameters were the same as in Example 5, including the time required for coating, the coating thickness and the specific energy consumption. No trace of residual oxide could be detected under the coating. It is evident that simultaneous cleaning and coating may be carried out at no significantly higher cost of energy or time than cleaning alone.

EXAMPLE 7

The procedure of Example 5 was repeated but using a copper anode in place of the lead anode. The workpiece, which was not immersed in the electrolyte, was a thin steel strip 0.3 mm in thickness which was soiled and was not subjected to prior cleaning. After a treatment time of 20 seconds a copper coating which was 7 to 8 micrometers thick had been formed and the specific energy consumption was about 0.5 kWh/m$^2$.

EXAMPLE 8

The procedure of Example 7 was repeated except that the electrolyte comprised an aqueous solution containing 10% by weight of sodium carbonate and 3% of copper sulphate. The results of Example 7 were reproduced, but the copper coating was significantly smoother than that of Example 7. Unlike electroplating, where the electrolyte is consumed, the concentration of the copper salt is maintained by the erosion of the anode and does not need to be otherwise maintained.

EXAMPLE 9

The procedure of Example 7 was repeated using a brass anode of composition zinc 20% by weight and copper 80% by weight. The resultant coating on the steel strip had a composition of approximately zinc 25% by weight and copper 75% by weight.

EXAMPLE 10

The procedure of Example 9 was repeated using a composite anode constructed of alternating plates of zinc and copper (end-on to the working surface of the anode), the zinc and copper plates were of similar thickness and channels (approximately 1 mm in diameter) which exited on the working surface of the anode were provided within each plate for the passage of the electrolyte. More holes were provided in the copper plates than in the zinc plates, and the relative numbers of holes in the two components determined the composition of the coated brass alloy. For a ratio of 3:5 (holes in zinc plates to holes in copper plates) a coating composition of 20% by weight Zn:80% by weight Cu was obtained. Generally, a better control of the coating composition is obtained by using composite anodes, rather than alloy anodes.

We claim:

1. An electrolytic process for simultaneously cleaning and metal-coating the surface of a workpiece of an electrically conducting material, which process comprises:

i) providing an electrolytic cell with a cathode comprising the surface of the workpiece and an anode comprising the metal for metal-coating of the surface of the workpiece;

ii) introducing an electrolyte into the zone created between the anode and the cathode by causing it to flow under pressure through at least one opening in the anode and impinge on the cathode; and iii) applying a voltage between the anode and the cathode and operating in a regime in which the electrical current decreases or remains substantially constant with increase in the voltage applied between the anode and the cathode, and in a regime in which discrete gas bubbles are present on the surface of the workpiece during treatment.

2. A process as claimed in claim 1 wherein the workpiece has a surface which is selected from the group consisting of a single metal and an alloy of two or more metals.

3. A process as claimed in claim 2 wherein the material from which the anode is made is the same material as that of the surface of the workpiece.

4. A process as claimed in claim 2 wherein the material from which the anode is made is a different material from that of the surface of the workpiece.

5. A process as claimed in claim 1 wherein the anode is a composite structure assembled from more than one material selected from the group consisting of single metals and alloys.

6. A process as claimed in claim 1 wherein the anode is formed from a material selected from the group consisting of wire mesh, expanded metal and porous metal.

7. A process as claimed in claim 1 in which the surface of the workpiece is not immersed in the electrolyte.

8. A process as claimed in claim i wherein the anode has a plurality of openings which extend through the anode to a working face thereof.

9. A process as claimed in claim 8 wherein said openings comprise holes.

10. A process as claimed in claim 8 wherein said openings comprise channels.

11. A process as claimed in claim 8 wherein said openings comprise apertures.

12. A process as claimed in claim 1 wherein the electrolyte flows under pressure through the anode as a plurality of jets and wherein an electrically insulated screen is positioned in the electrolytic cell adjacent the anode in order to refine the jets of electrolyte emerging from the anode into finer jets which impinge upon the cathode.

13. A process as claimed in claim 1 wherein the surface of the workpiece is immersed in the electrolyte.

14. A process as claimed in claim 1 wherein the electrolyte contains at least one water-soluble ionisable compound of the metal which is to be coated onto the surface of the workpiece.

15. A process as claimed in claim 1 wherein a plurality of anodes are used.

16. A process as claimed in claim 15 wherein said workpiece has opposing sides and at least one anode is disposed on one side of a workpiece to be treated and at least one anode is disposed on the opposite side of the workpiece to be treated, whereby the opposite sides of the said workpiece are simultaneously cleaned and coated.

17. A process as claimed in claim 16 wherein the workpiece is in a form selected from the group consisting of a metal strip, a metal sheet and a metal slab.

18. A process as claimed in claim 16 wherein the opposite sides of the workpiece are coated with different metal coatings.

19. A process as claimed in claim 16 wherein the opposite sides of the workpiece are coated with metal coatings of different thicknesses.

20. A process as claimed in claim 1 wherein the workpiece is a pipe.

21. A process as claimed in claim 1 wherein the workpiece is made from stainless steel.

22. A process as claimed in claim 1 wherein the surface of the workpiece moves relative to the anode during the treatment.

23. A process as claimed in claim 1 wherein the anode comprises an electrically-conducting material.

* * * * *